US009472124B2

(12) United States Patent
Ludwig et al.

(10) Patent No.: US 9,472,124 B2
(45) **Date of Patent: *Oct. 18, 2016**

(54) SAFETY LABEL COVERING AN INDIVIDUAL PACKAGING

(75) Inventors: Frank Ludwig, Melsungen (DE); Reinhard Kuge, Melsungen (DE); Marco Dieling, Felsberg (DE)

(73) Assignee: FAUBEL & CO NACHFOLGER GMBH (DE)

( * ) Notice: Subject to any disclaimer, the term of this patent is extended or adjusted under 35 U.S.C. 154(b) by 412 days.

This patent is subject to a terminal disclaimer.

(21) Appl. No.: 13/394,480

(22) PCT Filed: Aug. 31, 2010

(86) PCT No.: PCT/DE2010/001023

§ 371 (c)(1),
(2), (4) Date: Apr. 20, 2012

(87) PCT Pub. No.: WO2011/029422

PCT Pub. Date: Mar. 17, 2011

(65) Prior Publication Data

US 2012/0193904 A1 Aug. 2, 2012

(30) Foreign Application Priority Data

Sep. 8, 2009 (DE) ..... 20 2009 012 194 U

(51) Int. Cl.
*B42D 15/00* (2006.01)
*G09F 3/00* (2006.01)
(Continued)

(52) U.S. Cl.
CPC ..... *G09F 3/0292* (2013.01); *A61J 1/035* (2013.01); *B65D 75/367* (2013.01); *B65D 2215/00* (2013.01); *B65D 2575/367* (2013.01)

(58) Field of Classification Search
CPC ... A61J 1/035; B65D 75/367; B65D 75/327; B65D 2575/3236; B65D 2215/00; G09F 3/0292
USPC ..... 206/532, 469, 531, 528, 534.1; 283/81
See application file for complete search history.

(56) References Cited

U.S. PATENT DOCUMENTS 3,630,346 A 12/1971 Burnside ..... 206/56
3,759,371 A 9/1973 Marks ..... 206/42
(Continued)

FOREIGN PATENT DOCUMENTS

DE 10 2007 017856 A1 10/2008
WO WO 2004/085266 10/2004

OTHER PUBLICATIONS

Office Action mailed Jun. 24, 2014 in corresponding European Patent Application No. 10 771 630.0, along with an English translation of relevant portions thereof.
(Continued)

*Primary Examiner* — Andrew Perreault
(74) *Attorney, Agent, or Firm* — Ostrolenk Faber LLP

(57) ABSTRACT

The invention relates to a security label for protecting medicaments contained in an individual packaging, comprising a security layer (10, 110, 210) that can be stuck on the individual packaging. Removable elements (16, 216) are formed in the security layer (10, 110, 210), in the region of the medicaments (15) to be inserted, in such a way that cuts (17) are made in the security layer (10, 110, 210), on the edge of the removable elements (16, 216), said cuts (17) following a virtual cut strip. In order to produce such a security label that can be easily opened, but still provides protection against unauthorized opening by children or inadvertent opening, and can be produced cost-effectively, obstacle points are provided on the cut strip, forming a resistance when the removal element is removed.

16 Claims, 4 Drawing Sheets

(51) Int. Cl.
*A61J 1/03* (2006.01)
*B65D 75/36* (2006.01)

(56) References Cited

U.S. PATENT DOCUMENTS

| | | | | |
|---|---|---|---|---|
| 4,988,004 | A | 1/1991 | Intini | |
| 5,758,774 | A * | 6/1998 | Leblong | 206/531 |
| 5,785,180 | A | 7/1998 | Dressel et al. | |
| 6,036,016 | A * | 3/2000 | Arnold | 206/532 |
| 7,063,211 | B2 | 6/2006 | Williams-Hartman | 206/532 |
| 7,188,728 | B2 | 3/2007 | Williams-Hartman | 206/532 |
| 7,448,496 | B2 | 11/2008 | Williams-Hartman | 206/532 |
| 7,665,610 | B2 | 2/2010 | Williams-Hartman | 206/532 |
| 7,905,355 | B2 | 3/2011 | Williams-Hartman | 206/532 |
| 8,865,283 | B2 | 10/2014 | Ludwig et al. | 428/43 |
| 8,978,890 | B2 | 3/2015 | Ludwig et al. | 206/532 |
| 2007/0235366 | A1 | 10/2007 | Desai et al. | |
| 2008/0073240 | A1 | 3/2008 | Bowers et al. | 206/532 |

OTHER PUBLICATIONS

International Search Report dated Apr. 5, 2011 issued in corresponding international patent application No. PCT/DE2010/001023.

* cited by examiner

SAFETY LABEL COVERING AN INDIVIDUAL PACKAGING

CROSS REFERENCE TO RELATED APPLICATIONS

The present application is a 35 U.S.C. §371 National Phase conversion of PCT/DE2010/001023, filed Aug. 31, 2010, which claims benefit of German Application No. 20 2009 012 194.1, filed Sep. 8, 2009, the disclosure of which is incorporated herein by reference.

BACKGROUND ON THE INVENTION

The present invention relates to a safety label for protecting medicaments contained in an individual packaging.

US 2007/0235366 A1 discloses a label for affixing to a blister packaging, which label comprises a cardboard sheet which is adhesively bondable to the blister packaging, and a polymer film, which is adhesively bonded to the cardboard sheet. Circular perforations are provided in the cardboard sheet in the region of the medicament troughs to be expected of the blister packaging and covered in turn by the polymer film. The polymer film is likewise divided into individual segments by perforations, wherein each segment can be assigned to one medicament trough. In order to remove an individual medicament, first the segment must be removed so that the cardboard sheet is exposed at this point, before the medicament can be pushed through the aluminum foil of the blister packaging and the perforated region of the cardboard sheet.

Blister packaging comprises a number of troughs, in which in each case one medicament is packaged using a covering film, typically made of aluminum. This covering film can be readily pierced, with the result that the medicament drops out or can be removed. As a result, there is a risk that the aluminum foil covering the medicaments accidentally tears open and the medicament either becomes dirty or is lost, or there is a risk that the aluminum foil is opened by unauthorized persons, for example by small children while playing, and that the children then swallow these medicaments.

It has been found, however, among other things, that the cover made of polymer film can be much too easy to remove, with the result that small children can absolutely access the medicaments.

SUMMARY OF THE INVENTION

Proceeding from this, the present invention is based on the object of providing a safety label of the type mentioned at the outset which, whilst it can be opened easily, offers protection against unauthorized opening by children or accidental opening and can be produced in a cost-effective manner.

As a technical way of achieving this object, the invention proposes a safety label of the type mentioned in the introduction.

A safety label configured according to this technical teaching has the advantage that the impeding areas arranged on the cutting path produce such a great accumulated resistance that accidental opening of the medicament troughs is made more difficult. At the same time, it is also more difficult for children to open these medicament troughs.

In one preferred embodiment, the impeding areas are configured as a retaining web, which is formed between two cuts, or as a cross cut or as a curve. Any of these impeding areas make the pull-off operation more difficult in their own way, a retaining web owing to the material connection between pull-off element and safety sublayer, which connection must first be destroyed, a cross cut owing to the deflection of the pull-off motion in two directions, which are both undesired, and a curve owing to the reversal of the pull-off motion. In this case, a cross cut is arranged orthogonal to the edge of the pull-off element.

It can be appreciated that, while the pull-off element is pulled off, the cuts offer almost no resistance at all, whereas the impeding areas bring a fluid pull-off motion to an abrupt stop, with the result that the pull-off element can be pulled off further only against significant resistance.

Depending on the application requirement, a plurality of impeding areas can be formed at the periphery of the pull-off element. It is possible to adjust the resistance during pulling off of the pull-off element, which is necessary in each individual case, by way of the number of these impeding areas.

It has proven particularly advantageous to arrange a retaining web between a cut and a cross cut, since this synergistically increases the resistance action, with the result that the desired resistance is attained with simple, cost-effective means.

In another, preferred embodiment, the cutting path has a curvature of between 30° and 120°, in particular between 70° and 100°, preferably 90°. This has the advantage that the user must change the pull-off direction during the pull-off operation. This succeeds only in the case of considerable motor skills, which are present in adults but not in small children. As a result, this provides good resistance to opening by children.

In another, preferred embodiment, the cutting path has a curve of between 140° and 200°, in particular between 160° and 180°. This has the advantage that the user must at least nearly reverse the pull-off device during the pull-off operation. This succeeds only in the case of considerable motor skills, which are present in adults but not in small children. As a result, this provides good resistance to opening by children.

A further advantage is that the resistance is very much greater in the region of a curve than the resistance offered by an impeding area.

As a result, the pull-off operation at least temporarily stops in such a curve, while the pull-off operation can be continued for the remainder. Such a curve can thus be used to control the pull-off operation.

In another preferred embodiment, a gripping lug is formed on the pull-off element, wherein the gripping lug is completely surrounded by a cut, without an impeding area being present there. This has the advantage that the gripping lug can be freed relatively easily from the safety position, with the result that the pull-off element can be gripped by this gripping lug and then pulled off entirely. A further advantage is that small children, owing to their not yet fully developed motor skills, will find it difficult to find this gripping lug, to free it and to grip it. Consequently, this ensures relatively good resistance to opening by children, while the gripping lug represents no obstacle to an adult patient.

In a further, preferred embodiment, a holding lug is formed on the pull-off element. This holding lug, and all other edges of the pull-off element as well, are provided with cuts and impeding areas.

It has proven advantageous to form a U-shaped or V-shaped curve between the holding lug and the gripping lug. This U-shaped or V-shaped curve has the advantage that the motion during pull-off of the pull-off element is virtually stopped in this curve, because the pull-off motion comes to a stop in the deepest point of the curve. In order to be able then to pull off the pull-off element further, first the pull-off direction needs to be changed drastically here, which in the normal case necessitates effort and requires a high level of motor skills. Consequently, the pull-off operation is first resumed at the other locations of the pull-off element, such that the holding lug is pulled off last.

In one advantageous development, the gripping lug extends all the way into the curve, with the result that the gripping lug of the pull-off element can be freed quickly and easily from the safety position, although in this case very soon the above-described resistance then occurs when pulling off the pull-off element, with the result that the pull-off element is pulled off first on that side of the pull-off element that is located opposite the holding lug.

In a further preferred embodiment, a cover sheet which is at least mostly detachable is attached to the safety sublayer. Information pertaining to the medicament can be printed onto said cover sheet. If this cover sheet is configured such that it is re-closable, it is also possible to attain a very neat and tidy appearance of the entire individual packaging, with the result that the individual packaging according to the invention has a pleasing appearance even after repeated use.

BRIEF DESCRIPTION OF THE DRAWINGS

Further advantages of the safety label according to the invention can be gathered from the attached drawing and the embodiments described below. The abovementioned features and those described below can also be used, according to the invention, in each case individually or together in any desired combination. The embodiments mentioned should not be understood to constitute a complete list but rather have an exemplary character.

DESCRIPTION OF PREFERRED EMBODIMENTS

Figure 1:
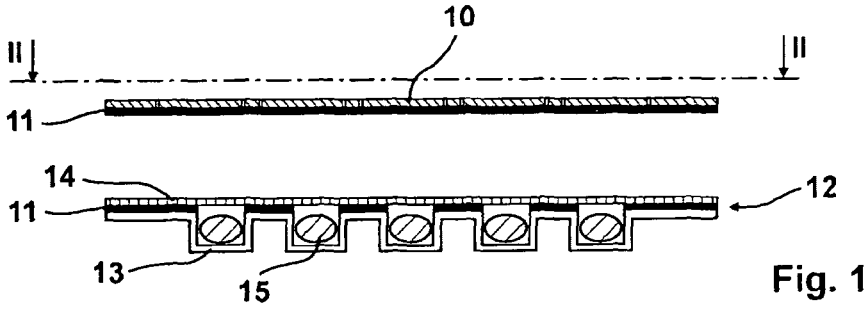
FIG. 1 shows an exploded view, illustrated in section, of a first embodiment of a safety label according to the invention with blister packaging, cut along line I-I in FIG. 2.
Figure 2:
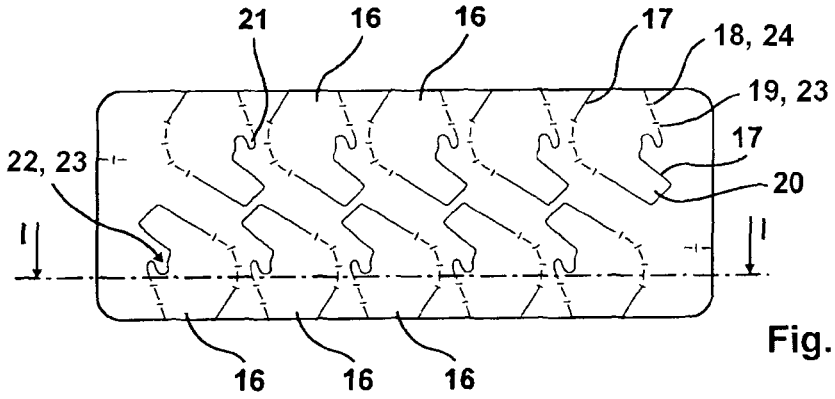
FIG. 2 shows a plan view of the safety label according to FIG. 1.

FIG. 1 and FIG. 2 illustrate a first embodiment of a safety label according to the invention, which comprises a safety sublayer 10, on the underside of which adhesive 11 is applied so that this safety label can be adhesively bonded to an individual packaging 12, for example to a blister. The individual packaging 12 comprises a medicament receiving means, formed from a dimensionally stable plastic, with a number of medicament troughs 13 and an aluminum foil 14, which is adhesively bonded thereto and by means of which the individual medicaments 15 are packaged in a sterile manner.

In the safety sublayer 10, for each medicament trough 13 pull-off element 16 is formed, the edge of which forms a virtual cutting path on which cuts 17 and cross cuts 18 are arranged. Provided between a cut 17 and a cross cut 18 is a holding web 19, which forms a material connection between the pull-off element 16 and the safety sublayer 10.

A gripping lug 20 is formed on each pull-off element 16 toward the center of the individual packaging 12 such that in the region of the gripping lug 20 no holding webs but rather a continuous cut 17 is provided.

A holding lug 21 is formed on one side of the pull-off element 16, with a curve 22 being formed between the holding lug 21 and its pull-off element 16, in particular the gripping lug 20. A cut 17 is formed in the curve 22, without holding webs being present in the region of the curve 22.

The edge of the pull-off element 16 has a curved configuration on a side of the pull-off element 16 that is located opposite the holding lug 21, the curvature being about 90°. Arranged in the region of the curvature are cuts 17 and cross cuts 18 in alternation, with a holding web 19 being formed between each cut 17 and the adjacent cross cut 18.

In order to remove a medicament 15 from the medicament trough 13, it is necessary to first remove the pull-off element 16 from the safety sublayer 10. To this end, first the gripping lug 20 needs to be peeled off its backing and gripped. This operation alone already requires a high level of motor skills and should be very difficult for small children.

Subsequently, the gripping lug 20 must be gripped so as to pull off the pull-off element 16 along the virtual cutting path. First, two impeding areas 23 which create resistance are encountered, firstly in the region of the curve 22 and secondly in the first holding web 19 at the transition between the gripping lug 20 and the rest of the pull-off element 16. If the necessary force is applied, the holding web 19 tears and a third impeding area 24, the cross cut 18, is encountered. This cross cut also forms a certain resistance, which, however, can also be overcome by a patient of normal strength. Thus, while the user pulls the pull-off element 16 off the individual packaging 12 in this manner, he will not readily succeed in continuing to pull off the pull-off element 16 in the region of the curve 22, because this requires a change in direction. Such a change in direction, however, cannot be performed just yet because the side of the pull-off element that is located opposite the holding lug 21 is still attached to the safety sublayer 10. Consequently, the applied force will result in the pull-off element 16 being pulled off in the region of the curvature. However, this curvature then requires the user to change direction, which in turn requires a certain level of motor skill. Only when the side of the pull-off element 16 having the curvature is completely detached will the user succeed in pulling off the pull-off element 16 in the region of the holding lug 21.

As a result, a certain amount of force is required to overcome the resistance formed by the impeding areas, in particular the curve 22, the holding webs 19 and the cross cuts 18, and in addition a high level of motor skill is required in order to be able to follow the curved line at the edge of the pull-off element 16.

Thus, once the individual packaging 12 is exposed in the region of the medicament 15 to be removed, the medicament 15 can be pushed through the aluminum foil 14 and removed in a manner known per se.

Figure 3:
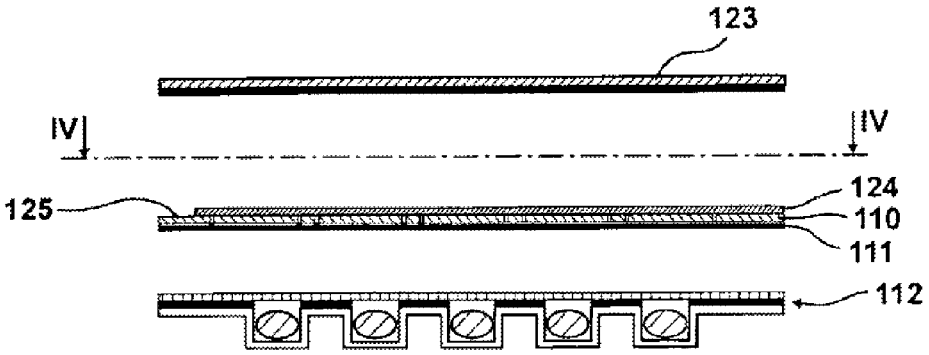
FIG. 3 shows an exploded view, illustrated in section, of a second embodiment of a safety label according to the invention with blister packaging, cut along line III-III in FIG. 4.
Figure 4:
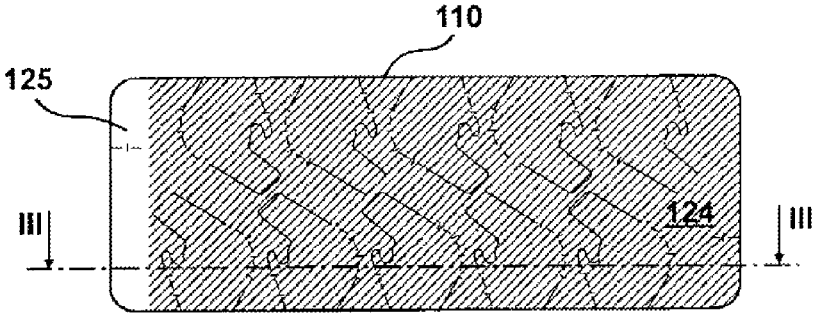
FIG. 4 shows a plan view of the safety label according to FIG. 3, corresponding to line IV-IV in FIG. 3.
Figure 5A:
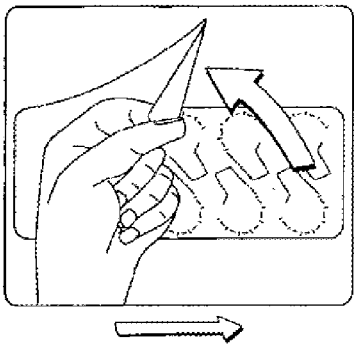
FIG. 5*a-e* show a schematic illustration of the sequence when removing a medicament from the individual packaging with a safety label according to the invention.
Figure 5B:
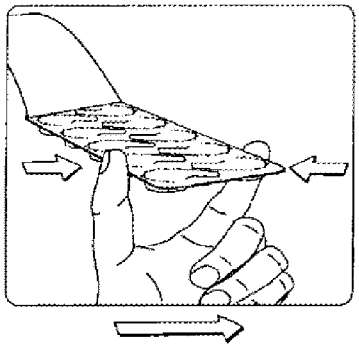
Figure 5C:
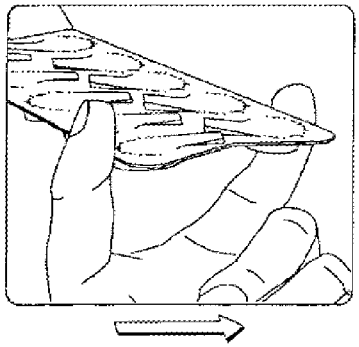
Figure 5D:
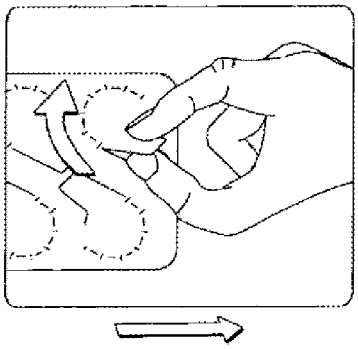
Figure 5E:
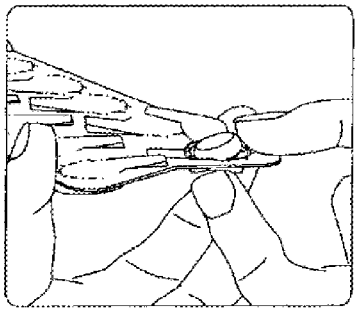

The second embodiment illustrated in FIG. 3 and FIG. 4 of a safety label according to the invention is identical to the first embodiment illustrated in FIG. 1 and FIG. 2 in terms of the safety sublayer 110 and the individual packaging 112; however in this second embodiment a cover sheet 123 is additionally provided, which is adhesively bonded, flush, to the safety sublayer 110. In addition, a silicone layer 124 is applied on the safety sublayer 110, except for on a band 125, so that the cover sheet 123 can be opened several times and subsequently closed again reliably.

Figure 6:
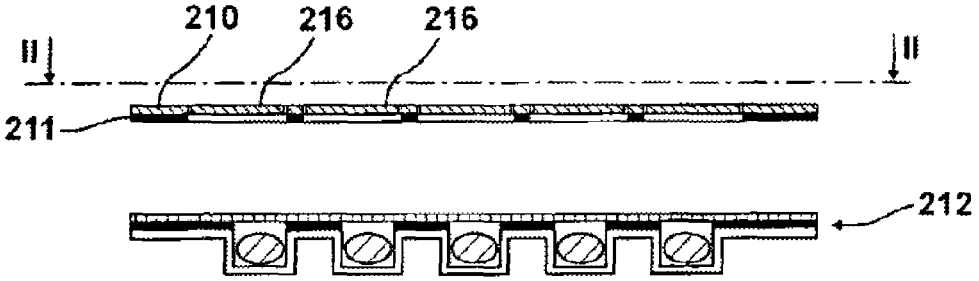
FIG. 6 shows an exploded view, illustrated in section, of a third embodiment of a safety label according to the invention with blister packaging.

The third embodiment, illustrated in FIG. 6, differs from the first embodiment, illustrated in FIG. 1, merely in that no adhesive 211 is applied on the safety sublayer 210 in the region of the pull-off element 216, so that the pull-off element 216 bears against the individual packaging 212 without any adhesive bond.

The operation of removing a medicament will be explained in further detail below with reference to FIG. 5*a* to FIG. 5*f*:

first, the cover sheet is gripped and pulled off the safety sublayer such that the cover sheet is adhesively bonded to the safety sublayer only at its bond. Subsequently the entire safety label together with the individual packaging can be held between thumb and index finger and thumb and index finger can be squeezed lightly together. In doing so, the center of the individual packaging curves slightly upward, as a result of which at least some gripping lugs of the pull-off elements partially lift off from the safety sublayer. Such a gripping lug can then be gripped in a simple manner in order then to remove the pull-off element 16. When the pull-off element is pulled off, the user quickly encounters a first impeding area in the form of a retaining web on one side of the pull-off element and a second impeding area in the form of a curve between the pull-off element and the holding lug. In order to pull off the pull-off element further, the pull-off direction would now have to be reversed in the region of the curve, which, however, is not practically possible. Consequently, the pull-off operation is interrupted at this point. If the user pulls again on the gripping lug, the retaining web is destroyed and the pull-off element is pulled off further along the virtual cutting path. Next, the user encounters a cross cut, which likewise represents an impeding area because, owing to the cross cut, the tendency is to divert the pull-off direction in the direction of the cross cut. A further retaining web is provided after this cross cut along the cutting path. Thus, if the user continues to pull on the gripping lug, this retaining web, too, is severed and the pull-off element can be pulled off further along the virtual cutting path. Owing to the curvature in the virtual cutting path, the user will then have to continue to pull off the pull-off element in a curved path, with the pull-off direction being rotated by 90°. This requires a certain amount of dexterity, since such a change in direction does not automatically take place. Once the change in direction is complete, the pull-off element can continue to be pulled off until the relevant side of the pull-off element is completely detached. Subsequently, the user can either continue to pull off the pull-off element in the region of the holding lug, or said pull-off element can be left attached here and pushed to the side. As can be gathered from FIG. 5*e*, it is subsequently possible by pressing on the medicament trough to push the actual medicament against the aluminum foil and to push it through the base sublayer.

Initial tests have shown that, as a result of the combination of motor skills with the knowledge that the medicament can best be removed in the region of the opening cuts, this safety label is resistant to opening by children.

A method for pulling a pull-off element off a safety label which is applied on an individual packaging, is characterized in that the individual packaging is at least temporarily bent such that gripping lugs of the pull-off element become detached.

A method for pulling a pull-off element off a safety label which is applied on an individual packaging, is characterized in that, during the pull-off operation, the direction of the pull-off operation is changed by 30° to 120°, in particular by 70° to 100°, preferably by 90°.

A method for pulling a pull-off element off a safety label which is applied on an individual packaging, is characterized in that, during the pull-off operation, the pull-off direction is reversed, wherein the pull-off direction is changed by 140° to 200°, preferably by 160° to 180°.

A method for pulling a pull-off element off a safety label which is applied on an individual packaging, in particular according to one of the preceding methods, is characterized in that the pull-off operation along one side of the pull-off element is temporarily stopped so that the pull-off operation is carried out for the time being along another side of the pull-off element.

A method for pulling a pull-off element off a safety label which is applied on an individual packaging, in particular according to one of the preceding methods, is characterized in that the pull-off operation along a first side begins only after the pull-off operation along a second side is completed.

A method according to one of the preceding methods, is characterized in that the pull-off operation is subsequently completed on the first side.

LIST OF REFERENCE SIGNS

10, 110, 210 safety sublayer
11, 111, 211 adhesive
12, 112, 212 individual packaging
13 medicament trough
14 aluminum foil
15 medicament
16, 216 pull-off element
17 cut
18 cross cut
19 holding web
20 gripping lug
21 holding lug
22 curve
123 cover sheet
124 silicone layer
125 band

What is claimed is:

1. A safety label and an individual packaging, the safety label covering the individual packaging, the individual packaging comprising a plurality of troughs, the safety label comprising a safety sublayer adhesively bonded onto the individual packaging, wherein:

the safety sublayer comprises pull-off elements, the pull-off elements being located in regions of the safety sublayer covering the troughs and being bordered by cuts and retaining webs between the cuts, the cuts and the retaining webs being provided in the safety sublayer, the pull-off elements are further bordered by impeding areas, the impeding areas impeding the pulling off of each of the pull-off elements, the impeding areas including a first impeding area which comprises at least one of: (1) a first cut which extends in a first direction which is perpendicular to a second direction in which a second cut, which is adjacent to the first cut, extends, (2) a third cut which extends in a third direction and in a fourth direction which is perpendicular to the third direction, (3) a fourth cut which extends in a fifth direction, which is partially opposite to a sixth direction in which a fifth cut, which is adjacent to the fourth cut, extends, or (4) a sixth cut which extends in a seventh direction and in an eighth direction which extends in a partially opposite direction from the seventh direction, a respective one of the pull-off elements is provided for each respective trough, and the impeding areas further include a second impeding area which comprises at least one first cut having a small radius of curvature, which is smaller than a large radius of curvature of at least one second cut at a location opposite to the at least one first cut, the radius of the small radius of curvature being so small that the pull-off movement of the pull-off element is temporarily stopped while the pull-off element is pulled off along the large radius of curvature.

2. The safety label and the individual packaging as claimed in claim 1, wherein one of the impeding areas comprises one of the retaining webs.

3. The safety label and the individual packaging as claimed in claim 1, wherein one of the impeding areas comprises a transverse cut.

4. The safety label and the individual packaging as claimed in claim 1, wherein the impeding areas further include a third impeding area which comprises a curve.

5. The safety label and the individual packaging as claimed in claim 1, wherein a retaining web is located between a cut and a transverse cut.

6. The safety label and the individual packaging as claimed in claim 4, wherein the curve has a curvature such that a tangent to the curve forms an angle of between 30° and 120° with a pull off direction before the curve begins.

7. The safety label and the individual packaging as claimed in claim 4, wherein the curve reverses the pull-off direction, with a curvature such that a tangent to the curve forms an angle of between 140° to 200° with a pull off direction before the curve begins.

8. The safety label and the individual packaging as claimed in claim 7, wherein the curve is U-shaped or V-shaped.

9. The safety label and the individual packaging as claimed in claim 4, wherein a holding lug and a gripping lug are included in at least one of the pull-off elements.

10. The safety element and the individual packaging as claimed in claim 9, wherein the curve is located between the holding lug and the gripping lug.

11. The safety label and the individual packaging as claimed in claim 1, wherein a gripping lug is included in at least one of the pull-off elements, and the gripping lug is completely surrounded by a cut.

12. The safety element and the individual packaging as claimed in claim 11, wherein the gripping lug extends all the way into the curve.

13. The safety element and the individual packaging as claimed in claim 9, wherein the curve is on a side of the at least one of the pull-off elements that is located opposite the holding lug.

14. The safety label and the individual packaging as claimed in claim 6, wherein the curve has a curvature such that a tangent to the curve forms an angle of between 70° and 100° with a pull off direction before the curve begins.

15. The safety label and the individual packaging as claimed in claim 6, wherein the curve has a curvature such that a tangent to the curve forms an angle of 90° with a pull off direction before the curve begins.

16. The safety label and the individual packaging as claimed in claim 7, wherein the curve has a curvature such that a tangent to the curve forms an angle of between 160° to 180° with a pull off direction before the curve begins.

* * * * *